US010856706B2

(12) United States Patent
Lewis

(10) Patent No.: US 10,856,706 B2
(45) Date of Patent: Dec. 8, 2020

(54) TOILET PAPER HOLSTER CHARGING STATION

(71) Applicant: Brian Lewis, Mount Union, PA (US)

(72) Inventor: Brian Lewis, Mount Union, PA (US)

( * ) Notice: Subject to any disclaimer, the term of this patent is extended or adjusted under 35 U.S.C. 154(b) by 26 days.

(21) Appl. No.: 16/374,908

(22) Filed: Apr. 4, 2019

(65) Prior Publication Data

US 2020/0138249 A1 May 7, 2020

Related U.S. Application Data

(63) Continuation-in-part of application No. 29/682,844, filed on Mar. 8, 2019.

(60) Provisional application No. 62/755,737, filed on Nov. 5, 2018.

(51) Int. Cl.
*A47K 10/22* (2006.01)

(52) U.S. Cl.
CPC ..... *A47K 10/22* (2013.01)

(58) Field of Classification Search
CPC ..... A47K 10/22
See application file for complete search history.

(56) References Cited

U.S. PATENT DOCUMENTS 4,882,568 A * 11/1989 Kyser ..... A47K 10/32 340/675
5,318,356 A 6/1994 Shelton
5,638,966 A * 6/1997 Kuntz ..... A47K 10/40 211/153
5,878,893 A * 3/1999 Micienko ..... A47K 10/38 211/13.1
6,026,605 A 2/2000 Tippett
6,427,606 B1 8/2002 Klotz
6,642,450 B1 11/2003 Hsiao
6,913,369 B2 7/2005 Chadwick
7,407,237 B2 * 8/2008 Bright ..... A47B 67/02 312/242
10,123,614 B2 * 11/2018 Trujillo ..... A47B 46/00
2007/0095769 A1 * 5/2007 Jenkins ..... A47K 10/38 211/119.009
2018/0177337 A1 * 6/2018 Prior ..... A47J 37/0786
2018/0360206 A1 * 12/2018 Trujillo ..... A47K 10/22
2019/0290078 A1 * 9/2019 Moses ..... A47K 1/09

* cited by examiner

*Primary Examiner* — William A. Rivera
(74) *Attorney, Agent, or Firm* — Boudwin Intellectual Property; Daniel Boudwin

(57) ABSTRACT

A toilet paper holster charging station. The toilet paper holster charging station includes a housing having a top portion with opposing arms extending from a bottom thereof. A support shaft spans between the opposing arms and is rotatably attached thereto. The support shaft is removably affixed to the opposing arms and can hold a roll of toilet paper thereon. An electrical outlet is disposed in an arm of the housing and includes standard sockets as well as Universal Serial Bus (USB) outlets for plugging in and charging devices. The electrical outlet is configured to be connected to the electrical grid of a house through wired connection running through the walls. A shelving portion is included on the top surface of the housing to allow a user to rest an electrical device thereon while charging.

15 Claims, 4 Drawing Sheets

TOILET PAPER HOLSTER CHARGING STATION

CROSS REFERENCE TO RELATED APPLICATIONS

This application claims the benefit of U.S. patent application Ser. No. 29/682,844, filed on Mar. 8, 2019 and claims the benefit of U.S. Provisional Application No. 62/755,737 filed on Nov. 5, 2018. The above identified patent application is herein incorporated by reference in its entirety to provide continuity of disclosure.

BACKGROUND OF THE INVENTION

The present invention relates to restroom charging devices. More specifically, the present invention relates to a toilet paper holster charging station having a hollowed support member configured to provide an externally accessible power source.

People often use their smartphones while going to the bathroom to pass the time or to be productive. Phones may be at risk for drops and damages as an individual sits on the toilet as well. Phones tend to lose their charge after extended use while using the restroom. Restrooms also typically lack a convenient charging means in close proximity to the toilet. Some individuals may even set their phone down on the ground and risk contracting germs and bacteria on their phone which may then be transferred onto the user's hands and face. Cell phones dropped into a toilet may cause the device to malfunction or even be ruined completely. Additionally, phones damaged in this way may potentially void their manufacturer's warranty and have to be repaired or replaced at the owner's expense. Accordingly, a device that is configured to receive a phone thereon while enabling an individual to perform routine bathroom activities is desired.

Devices have been disclosed in the known art that relate to restroom charging devices. These include devices that have been patented and published in patent application publications. These include devices generally relate to horizontally supported planar surfaces having means for supporting an electrical component. These devices, however, fail to disclose all the elements of the present invention.

SUMMARY OF THE INVENTION

In view of the foregoing disadvantages inherent in the known types of restroom charging devices now present in the known art, the present invention provides a toilet paper holster charging station wherein the same can be utilized for providing convenience to a user attempting to safely charge their phone while using the toilet.

It is therefore an object of the present invention to provide a new and improved toilet paper holster charging station that has all of the advantages of the known art and none of the disadvantages.

It is another object of the present invention to provide a toilet paper holster charging station comprising a housing having a top shelving portion and two opposing arms extending downwards from either side thereon, a support shaft spanning between the opposing arms adapted to hold a roll of toilet paper thereon, a power outlet disposed in an arm configured to be connected to the electrical grid of a house and having sockets thereon to allow a user to plug in and charge various electronic devices.

Another object of the present invention is to provide a toilet paper holster charging station wherein the support shaft is rotatably connected and removably detachable to the opposing arms.

Yet another object of the present invention is to provide a toilet paper holster charging station wherein the power outlet includes Universal Serial Bus (USB) outlets.

Still another object of the present invention is to provide a toilet paper holster charging station wherein the top shelving portion of the housing includes a rubber layer for additional friction to prevent devices from slipping.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
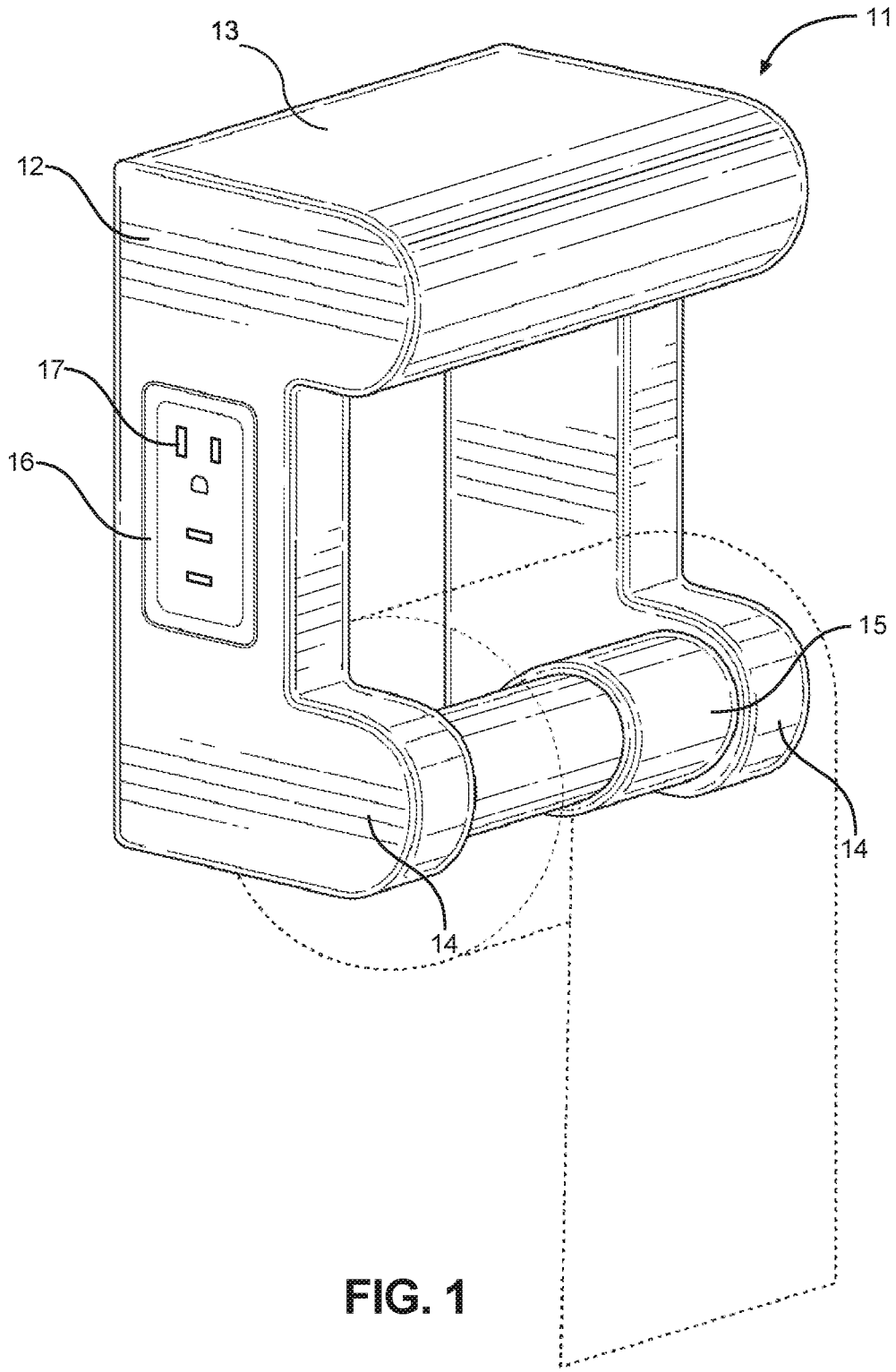
FIG. 1 shows a perspective view of an embodiment of the toilet paper holster charging station.

Reference is made herein to the attached drawings. Like reference numerals are used throughout the drawings to depict like or similar elements of the toilet paper holster charging station. For the purposes of presenting a brief and clear description of the present invention, the preferred embodiment will be discussed as used for providing a convenient shelving and recharging station within a toilet paper holder. The figures are intended for representative purposes only and should not be considered to be limiting in any respect.

Referring now to FIG. 1, there is shown a perspective view of an embodiment of the toilet paper holster charging station. The toilet paper holster charging station 11 comprises a housing structure 12 having a planar top portion 13 and two opposing arms 14 extending downward from either side thereon. The opposing arms 14 are symmetrical and extend orthogonally downward from an edge of the top portion 13 while running parallel to one another. A support shaft 15 spans between the ends of the opposing arms. A power outlet 16 is disposed within an opposing arm 14 having sockets 17 along an outer surface thereof. A rear surface of the housing structure 12 encloses the toilet paper holster charging station 11 such that the housing structure 12 defines an interior volume therein. The housing structure 12 being hollow so as to use less material and limit the weight.

Figure 2:
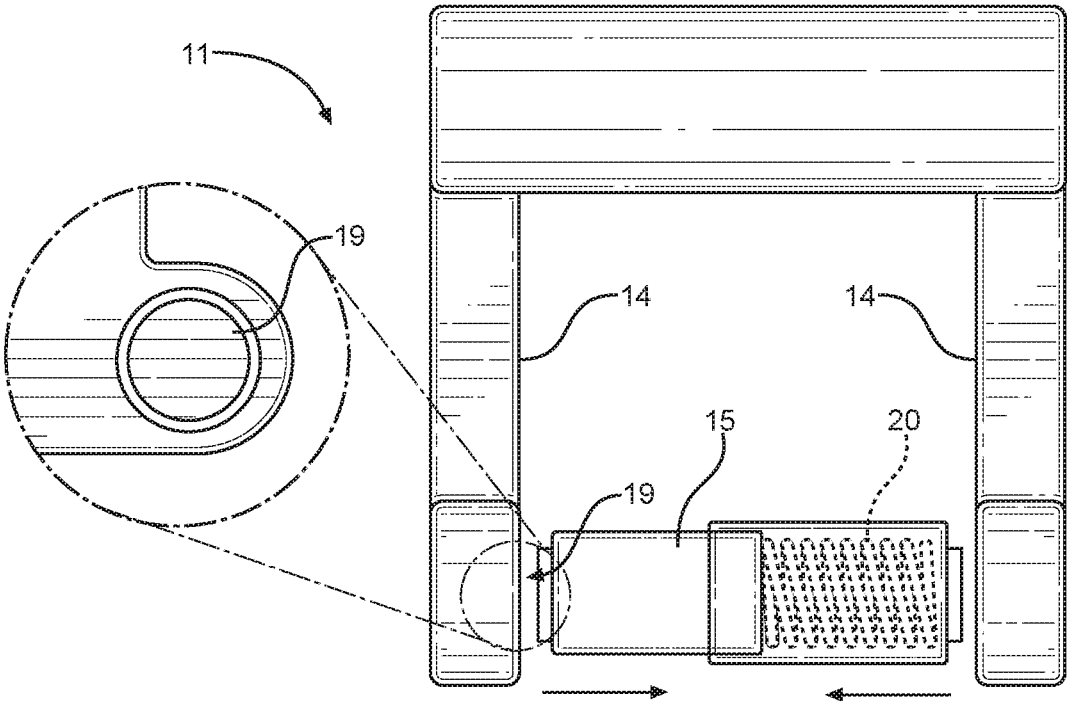
FIG. 2 shows a cross-sectional view of the support shaft of an embodiment of the toilet paper holster charging station.

Referring now to FIG. 2, there is shown a cross-sectional view of the support shaft of an embodiment of the toilet paper holster charging station. The support shaft 15 spanning between the opposing arms 14 is removably attachable therein to allow a user to remove the support shaft 15 to include a roll of toilet paper thereon or to remove an empty roll. Each opposing arm 14 includes a protrusion on the distal end thereof which has a circular recess 19 on the inner surface. These recesses 19 are adapted to receive the ends of the support shaft 15 such that the shaft 15 is rotatably connected to each arm 14. In the illustrated embodiment, the support shaft 15 is telescopically collapsible to allow it to removably attach to the opposing arms 14. The support shaft 15 includes a spring 20 within its interior to keep it biased in an extended position and to resist collapsing in upon itself telescopically. When installed within the recesses 19 of the opposing arms 14, the support shaft 15 is not secured via friction fit but is instead allowed to spin within the recesses 19 to allow for a roll of toilet paper to be unspooled by a user. In an alternative embodiment, the recesses 19 comprise an annular shape adapted to receive a correspondingly shaped end of the support shaft 15.

Figure 3:
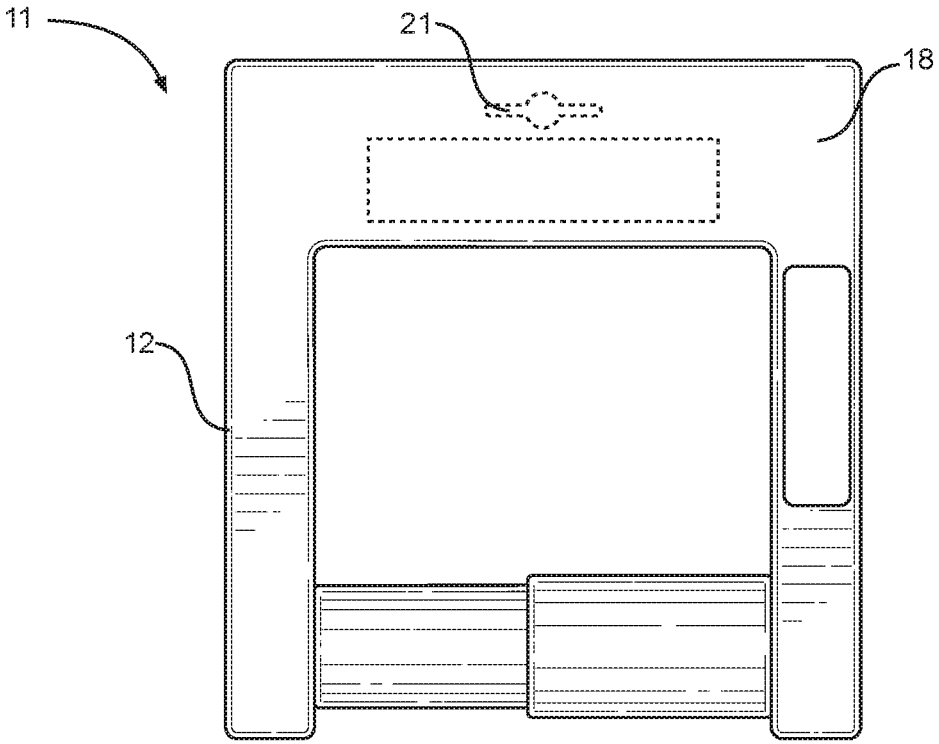
FIG. 3 shows a rear view of an embodiment of the toilet paper holster charging station showing the fastening surfaces.

Referring now to FIG. 3, there is shown a rear view of an embodiment of the toilet paper holster charging station showing the fastening surfaces. The rear surface 18 of the housing structure 12 is adapted to affix to the surface of a bathroom wall. In the illustrated embodiment, a fastening aperture 21 is included on the rear surface 18 of the housing structure 12. The fastening aperture 21 allows the housing structure 12 to be removably installed on a bathroom wall by placing a fastener installed on a bathroom wall through the aperture 21 and into the interior volume so as to allow the housing 12 to rest thereon. The toilet paper holster charging station 11 may also be permanently affixed to a bathroom wall by applying an epoxy directly to the rear surface 18 and pressing it firmly against the desired location. In this way, the rear surface 18 of the housing structure 12 will rest flush against the wall when affixed thereto.

Figure 4:
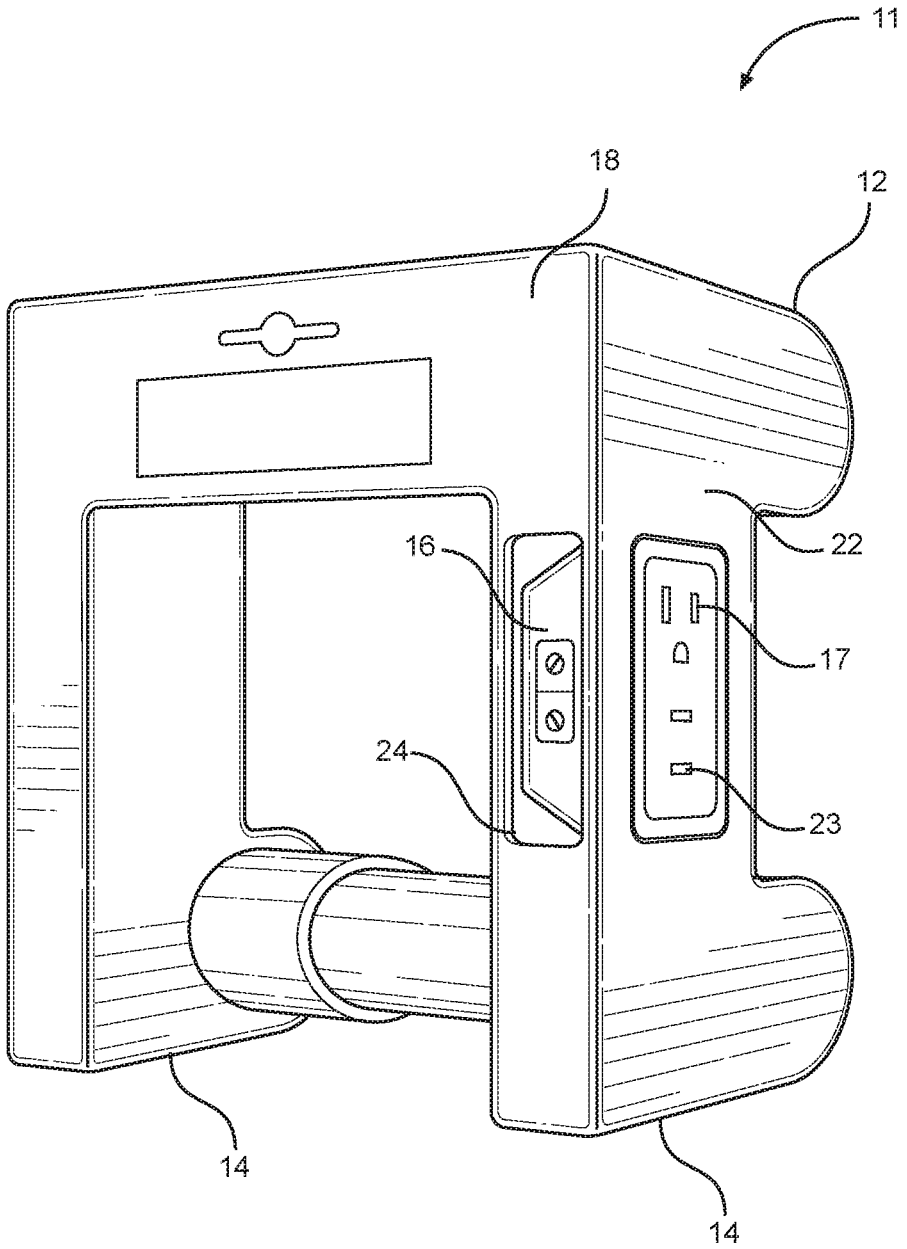
FIG. 4 shows a rear perspective view of an embodiment of the toilet paper holster charging station showing power outlet and connection opening.

Referring now to FIG. 4, there is shown a rear perspective view of an embodiment of the toilet paper holster charging station showing power outlet and connection opening. The power outlet 16 is included in an opposing arm 14 within the interior volume of the housing structure 12. The power outlet 16 is disposed within the arm 14 in a manner so that the socket connections lay flush with the exterior surface 22 of the arm. In the illustrated embodiment, the power outlet 16 includes standard Type B sockets 17 which are ubiquitous throughout North America. Other sockets 17 which are used in varying parts of the world may be included in alternate embodiments of the toilet paper holster charging station 11. The power outlet 16 also includes a USB slot 23 which is compatible with newer generations of charging connections as well as other electronic connections.

A connection opening 24 is included in the rear surface of the housing. The connection opening 24 is disposed in the rear surface 18 at the height of the power outlet 16 to allow for a user to access the power outlet 16 within the interior volume of the housing structure 12. The connection opening 24 allows the power outlet 16 to be wired directly into the electrical grid of a housing by running wires within the bathroom wall to a power connection. In an alternate embodiment, the power outlet 16 comprise a battery-operated assembly and include a removably attachable and rechargeable battery.

Figure 5:
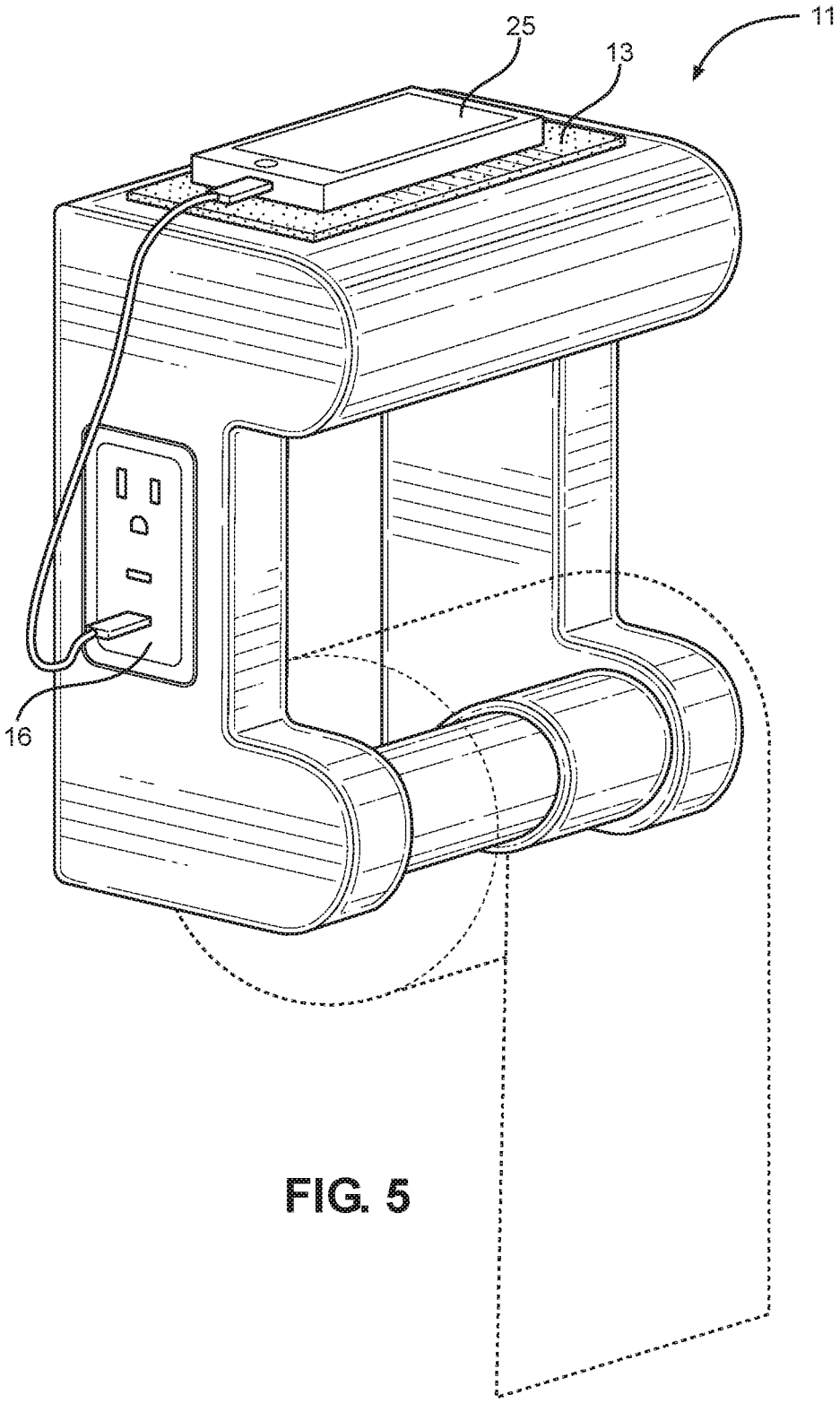
FIG. 5 shows a perspective view of an embodiment of the toilet paper holster charging station in use with electronic device.

Referring now to FIG. 5, there is shown a perspective view of an embodiment of the toilet paper holster charging station in use with electronic device. In practice, the toilet paper holster charging station 11 will be installed within a bathroom to provide a user sitting on a toilet a power outlet 16 within easy reach. A user may plug in and charge electronic devices such as smartphones 25 or laptops within the power outlet 16 for continued use and efficient charging. The top portion 13 of the toilet paper holster charging station 11 includes a planar shelving surface adapted to receive a small electronic device such as a smartphone 25. In the illustrated embodiment, an additional layer of rubber is included on the top portion 13 to increase the frictional engagement between an electronic device and the shelving surface to prevent slipping.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper holster charging station, comprising:

a housing structure having a top shelving section adapted to receive and hold an electronic device thereon;

a first arm and a second arm extending orthogonally away from a lower surface of the top shelving section at opposing sides thereof, wherein the first arm and second arm define an opening therebetween;

a support shaft spanning between the first and second arms;

a power outlet disposed on an exterior surface of the housing structure;

wherein the power outlet is disposed entirely within the housing structure;

wherein the power outlet is accessible from the side surface of one of the first arm and the second arm;

a fastening surface disposed on a rear side of the housing structure, the fastening surface configured to affix the device a wall.

2. The toilet paper holster charging station of claim 1, wherein the support shaft is rotatably connected to the first and second arms.

3. The toilet paper holster charging station of claim 1, wherein the support shaft is removably affixable to the first and second arms.

4. The toilet paper holster charging station of claim 1, wherein the support shaft is telescopically collapsible.

5. The toilet paper holster charging station of claim 4, wherein a spring within the shaft is bias to keep the shaft in an extended configuration and resist collapsing in upon itself.

6. The toilet paper holster charging station of claim 1, wherein the power outlet is disposed within the housing structure and is configured to electrically connect to an electrical grid via wiring.

7. The toilet paper holster charging station of claim 1, wherein the power outlet includes multiple socket slots.

8. The toilet paper holster charging station of claim 1, wherein the power outlet includes a Universal Serial Bus (USB) slot.

9. The toilet paper holster charging station of claim 1, wherein the top shelving section is planar in construction.

10. The toilet paper holster charging station of claim 1, further comprising an added layer of friction increasing material disposed on the surface of the top shelving porting of the housing.

11. The toilet paper holster charging station of claim 10, wherein the friction increasing surface comprises a rubber layer.

12. The toilet paper holster charging station of claim 1, wherein a fastening aperture is disposed on the fastening surface which allows the housing structure to be removably affixed to a wall.

13. The toilet paper holster charging station of claim 1, further comprising a planar back surface disposed on a rear side of the housing, the planar back surface orthogonally connected to the top shelving section and adapted to rest flush against a wall when affixed thereto.

14. The toilet paper holster charging station of claim 1, wherein the first arm and second arm are symmetrical to each other.

15. The toilet paper holster charging station of claim 1, further comprising a connection opening disposed in the rear surface at the height of the power outlet.

* * * * *